US008156666B1

(12) United States Patent
Deal, Jr.

(10) Patent No.: US 8,156,666 B1
(45) Date of Patent: Apr. 17, 2012

(54) TOPSOIL RESTORATION SYSTEM AND ASSOCIATED METHODS

(76) Inventor: Troy M. Deal, Jr., Orlando, FL (US)

( * ) Notice: Subject to any disclaimer, the term of this patent is extended or adjusted under 35 U.S.C. 154(b) by 0 days.

(21) Appl. No.: 12/137,808

(22) Filed: Jun. 12, 2008

Related U.S. Application Data

(60) Provisional application No. 60/943,668, filed on Jun. 13, 2007.

(51) Int. Cl.
*E02F 3/88* (2006.01)

(52) U.S. Cl. ..... 37/317; 37/323; 37/347

(58) Field of Classification Search ..... 37/317, 37/323, 324, 326, 329; 405/258.1, 52
See application file for complete search history.

(56) References Cited

U.S. PATENT DOCUMENTS 4,261,117 A * 4/1981 van der Peyl ..... 37/334
4,723,710 A * 2/1988 Lucore, II ..... 239/124
4,759,664 A * 7/1988 Deal ..... 405/258.1
4,776,731 A * 10/1988 Briggs et al. ..... 406/153
4,807,373 A * 2/1989 Sloan et al. ..... 37/322
4,896,445 A * 1/1990 Deal ..... 37/195
4,936,031 A * 6/1990 Briggs et al. ..... 37/347
5,035,543 A * 7/1991 Medemblik et al. ..... 406/39
5,421,105 A * 6/1995 Schulte ..... 37/309
5,428,908 A * 7/1995 Kerfoot ..... 37/323
6,000,151 A * 12/1999 Hayes ..... 37/323
6,273,512 B1 * 8/2001 Rajewski ..... 299/17
6,470,605 B1 * 10/2002 Gilman et al. ..... 37/323
6,484,422 B1 * 11/2002 Bain et al. ..... 37/323
6,550,692 B1 * 4/2003 Schacht ..... 239/172
6,691,436 B2 * 2/2004 Chizek, Sr. ..... 37/322
RE38,872 E * 11/2005 Hayes ..... 37/323
7,585,135 B1 * 9/2009 Deal, Jr. ..... 405/258.1
2005/0210623 A1 * 9/2005 Buckner ..... 15/340.1

* cited by examiner

*Primary Examiner* — Thomas Beach
*Assistant Examiner* — Matthew Buck
(74) *Attorney, Agent, or Firm* — Allen, Dyer, Doppelt, Milbrath & Gilchrist, P.A.

(57) ABSTRACT

A method for rehabilitating a land area comprises the step of using an excavating machine to extract dirt desired to be dispersed over the land area from another area, such as a ditch. The extracted dirt is mixed with water to form a slurry. The slurry is pumped to a high-pressure spray nozzle, and is then sprayed in a thin layer over the land area desired to be rehabilitated. The slurry can also be pumped to the land area at a controllable depth to achieve a desired land profile thereat.

9 Claims, 1 Drawing Sheet

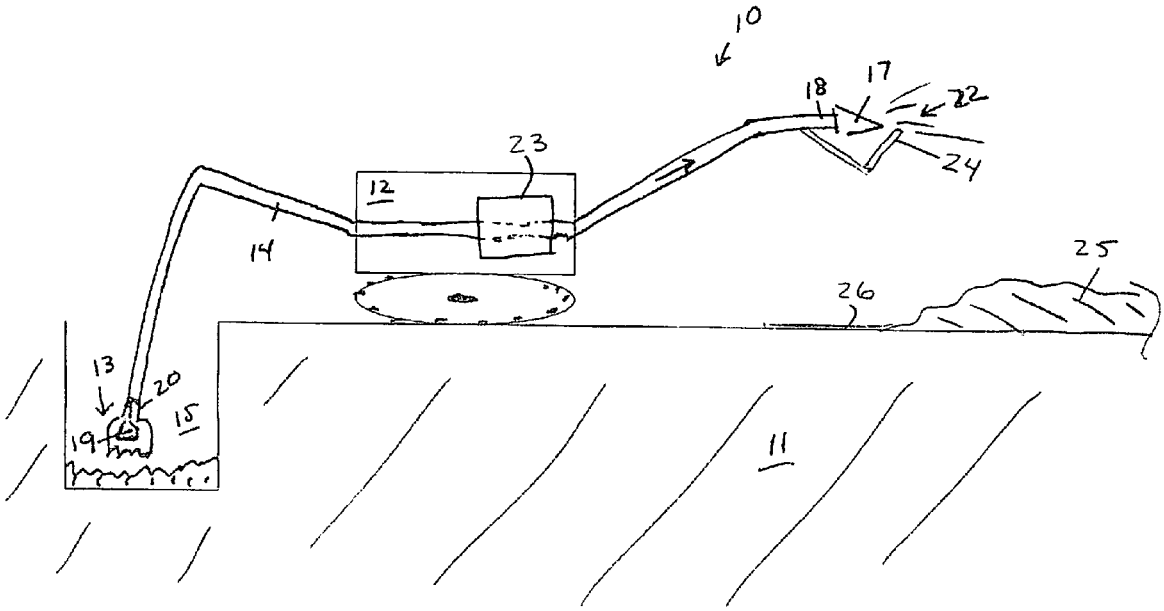
10
17
18
22
23
24
12
14
25
26
13
20
15
19
11

TOPSOIL RESTORATION SYSTEM AND ASSOCIATED METHODS

CROSS-REFERENCE TO RELATED APPLICATION

This application claims priority to provisional application Ser. No. 60/943,668, filed on Jun. 13, 2007.

BACKGROUND OF THE INVENTION

1. Field of the Invention

The present invention relates to systems and methods for restoring material to a land area that has been eroded away.

2. Description of Related Art

The present inventor has previously disclosed methods for restoring topsoil that has been eroded away, and also for dredging ditches in an environmentally friendly and cost-effective manner. Methods for dredging waterways are disclosed, inter alia, in U.S. Pat. Nos. 3,971,148; 4,240,243; 4,434,943; 4,517,754; 4,521,305; 4,575,960; 4,628,623; 4,759,664; 4,896,445; 5,167,469; and 5,211,511, which are incorporated by reference hereinto. These methods utilize a high-pressure nozzle to spray a thin layer of slurry material over a large area.

In the '148 patent, a dredge cutter head is described that is self-cleaning; in the '243 patent, satellite harvesters are used to harvest underwater aquatic growth; in the '943 patent, a pump intake cutter head is disclosed for pumping an aquatic growth slurry from a waterway or body of water; in the '754 and '960 patents, a cutterhead attachment for a dredge is described; in the '305 patent, a rotating self-cleaning screen is provided; in the '623 patent is described a turbidity control system for a dredge cutterhead; in the '664 patent, the slurry is formed of a solid material and water at a first location and pumped to a remote location for increasing the elevation of an area at the remote location; in the '445 patent, a waterway is dredged, and the dredged material is used to form a slurry that is then distributed over the adjoining area in a layer sufficiently thin to avoid negative impact on the environment; in the '469 and '511 patents, a slurry distribution system is disclosed.

Natural habitat disappearance is a persistent problem, and can be caused by a variety of damaging factors, including, but not limited to, human-caused factors and natural occurrences. Until now, topsoil restoration from ditches has been an expensive and labor-intensive process.

Therefore, it would be desirable to provide an apparatus and method for restoring land areas, for controlling elevation, and for improving the efficiency of an excavation process.

SUMMARY OF THE INVENTION

An aspect of the present invention is directed to the rehabilitation of land areas that have been subject to erosion, for example.

In one embodiment is provided a method for rehabilitating an area of land. The method comprises the step of using an excavating machine to extract dirt or other sedimented material desired to be dispersed over the land area from another area, such as a ditch. The extracted dirt is mixed with water to form a slurry. The slurry is pumped to a high-pressure spray nozzle, and is then sprayed over the land area desired to be rehabilitated.

A system of the present invention in one aspect is for rehabilitating an area of land. The system comprises an excavating machine movable to an area such as a ditch. The ditch could have water therein or be dry. An extractor, which can be adapted to add water if the ditch is dry, is affixed to the excavator and is configured to remove material from the ditch and create a slurry therefrom. A hose is in fluid contact with the extractor at a first end and a spray nozzle at a second, opposed end.

A pump is provided for pumping the slurry from the extractor into the hose. Also provided is a conveyance tube that leads from the seed container to an aperture in the hose. Means are also provided for directing the spray of slurry over the desired land area desired to be rehabilitated.

The present invention provides considerable savings in cost and time to rehabilitate a land area.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

BRIEF DESCRIPTION OF THE DRAWINGS

THE FIGURE is a schematic diagram of a system for distributing a topsoil slurry over an area to be rehabilitated.

DETAILED DESCRIPTION OF THE PREFERRED EMBODIMENTS

A description of the preferred embodiments of the present invention will now be presented with reference to THE FIGURE.

A system 10 (FIG. 1) of the present invention, believed at the time of filing to represent a preferred embodiment, in one aspect is for rehabilitating a land area 11. The system 10 comprises an excavating machine 12 movable to an area such as a ditch 15.

The ditch 15 could have water therein or be dry. An exemplary excavator 12 known in the art can be used.

An extractor 13, which can be adapted to add water if the ditch 15 is dry, is affixed to the excavator 12 and is configured to remove material from the ditch 15 and create a slurry therefrom. The extractor 13 can comprise, for example, an auger, although this is not intended as a limitation, and may comprise an exemplary extractor 13 such as known in the art. Preferably the extractor 13 comprises a suction extractor, which permits the excavation of very soft and slurried materials without bucket spillage, and with minimum turbidity created in the ditch 15, which is an improvement over the use of mechanical excavation or mechanical leveling heavy equipment for elevation control.

A hose 14 is in fluid contact with the extractor 13 at a first end 20 and a spray nozzle 17 at a second, opposed end 18. An excavator pump 19 is provided for pumping the slurry from the extractor 13 into the hose 14. Means are also provided for directing the spray 22 of slurry over the desired land area 11 desired to be rehabilitated, which can include in some instances a booster pump 23 in fluid communication with the slurry between the excavator pump 19 and the spray 22. The booster pump 23, if needed, increases the distance of throw of the slurried material by increasing the expulsion pressure. The nozzle 17 can comprise, if desired, a hydraulic directional controlled nozzle for placement control having a safety pressure relief. If desired, a diffuser probe 24 can be inserted into the spray 22, such as that taught in the current inventor's co-pending application Ser. No. 61/047,195. Such an element 24 can serve to widen the placement area and reduce the impact of the water column on the spray site 11 by softening and modifying the placement water column into a mist. The spray 22 can be used to deposit a thin layer 26, for example, or can be used to build up an area to control elevation, wherein the deposited slurry 25 has a greater elevation than the original land area 11.

Means are also provided for directing the spray 22 of slurry over the desired area 11 remote from the ditch 15. Such a directing means may comprise, for example, "jet spray" nozzle 17 devices such as are disclosed in the previously cited '664 or '445 patents, although these are not intended as limitations. The ability to direct the spray 22 remotely from the ditch 15 can serve to eliminate flow-back into the ditch 15 and minimize re-erosion. The slurry spray 22 can contain additives if desired, such as taught in the current inventor's co-pending patent application Ser. No. 11/221,378, such as, but not intended to be limited to, seeds or soil amendments.

Since the nozzle 17 and hose 14 are movable, the second site 11 can be selected from one or both sides of the ditch 15 without having to move the apparatus 10. Ditches 15 of a wide range of widths and depths can be excavated, including the very small types of ditch common in agricultural settings or drainage ditches, without changing equipment or experiencing re-flotation difficulties. Excavation can be carried out while moving continuously if desired, avoiding obstacles, thereby increasing production, permitting tight turns, all without stopping, with the apparatus 10 moving under its own power. A plurality of separated excavation sites 15 can be dredged, all without the need for replacement flotation, and carried out with one operator if desired and without the need for auxiliary equipment. The entire apparatus 10 can be unloaded from a trailer, moved to the ditch site 15, operated, and reloaded onto the trailer by one operator. In some cases it may even be possible to drive the apparatus 10 directly to the site 15.

The material can be distributed remotely from the ditch 15 by, for example, 150-300 feet, and the excavator 12 can be in substantially continuous motion, both features that are not found in the art at present. The present apparatus 10 has been found to have a multiplicity of benefits, among which are a reduction of sedimentation downstream at dams, loss of topsoil into bodies of water such as oceans, reduction of the need for fertilizers, maintenance of irrigation channels, restoration of waterways after a flood, reduction of aerobic bacteria in the sediment, which improves the marine environment, increasing agricultural production through improved drainage control at sites previously recognized as presenting difficulty owing to their small size, and improved topsoil availability.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiments thereof, and the advantageous new and useful results obtained thereby, the new and useful constructions, and reasonable mechanical equivalents thereof obvious to those skilled in the art, are set forth in the appended claims.

What is claimed is:

1. A topsoil restoration method comprising:

extracting a topsoil material from a first site from a land-based position;

mixing the extracted topsoil material with water to form a slurry;

pumping the slurry to a spray nozzle; and using the spray nozzle, spraying the slurry over a second site for topsoil restoration.

2. The method recited in claim 1, wherein the first site is a dry ditch and the extracting step comprises using a suction extractor and adding water to the first site during the extracting step.

3. The method recited in claim 2, further comprising moving the extractor to the first site.

4. The method recited in claim 1, wherein the second site is remote from the first site.

5. The method recited in claim 1, wherein the slurry-spraying step comprises using a high-pressure spray nozzle to spray a thin layer of slurry over the second site.

6. The method recited in claim 1, wherein the extracting, mixing, pumping, and spraying steps are performed with a unitary machine.

7. The method recited in claim 1, wherein the pumping step comprises pumping the extracted topsoil material from the first site prior to the mixing step, and pumping the slurry downstream through a hose into the spray nozzle.

8. A topsoil restoration method for controlling an elevation of a land site comprising:

adding water to a dry ditch having topsoil material therein;

extracting the topsoil material from the ditch;

forming a slurry with the topsoil material;

pumping the slurry to a spray nozzle; and using the spray nozzle, spraying the slurry over a site where topsoil restoration is desired.

9. A method for managing excavated earth material during land-based excavation, the method comprising:

continuously extracting an earth material from an excavation site using a mobile land-based excavator having a suction extractor;

forming a slurry with the extracted earth material;

pumping the slurry to a spray nozzle; and continuously spraying the slurry during the continuous extracting over a desired land area away from the excavation site.

* * * * *